US007325374B2

(12) United States Patent
Chrisman et al.

(10) Patent No.: US 7,325,374 B2
(45) Date of Patent: Feb. 5, 2008

(54) MODULAR INFEEDS FOR AUTOMATIC FORMS/FILL/SEAL EQUIPMENT

(75) Inventors: Kenneth P. Chrisman, Monroe, CT (US); Charles P. Tatarian, Yorba Linda, CA (US); Robert J. Simonelli, Worcester, MA (US); Mitchell W. Smith, Newton, NH (US); Thomas P. Orsini, Leominster, MA (US)

(73) Assignee: Shanklin Corporation, Ayer, MA (US)

( * ) Notice: Subject to any disclaimer, the term of this patent is extended or adjusted under 35 U.S.C. 154(b) by 1 day.

(21) Appl. No.: 10/979,378

(22) Filed: Nov. 2, 2004

(65) Prior Publication Data

US 2006/0090419 A1 May 4, 2006

(51) Int. Cl.
*B65B 41/12* (2006.01)
*B65B 9/00* (2006.01)
*B65B 11/50* (2006.01)

(52) U.S. Cl. ..... 53/389.2; 53/203; 53/545; 53/568

(58) Field of Classification Search ..... 53/441, 53/442, 450, 461, 463, 466, 509, 203, 228, 53/545, 548, 556, 557, 568, 586, 389.1, 389.2
See application file for complete search history.

(56) References Cited

U.S. PATENT DOCUMENTS

| | | | | |
|---|---|---|---|---|
| 4,035,983 | A * | 7/1977 | Shanklin et al. | 53/450 |
| 4,041,677 | A * | 8/1977 | Reid | 53/557 |
| 4,219,988 | A * | 9/1980 | Shanklin et al. | 53/568 |
| 4,924,659 | A * | 5/1990 | Watanabe | 53/550 |
| 4,939,889 | A * | 7/1990 | Watanabe | 53/450 |
| 5,187,922 | A * | 2/1993 | Mast | 53/586 |
| 5,592,881 | A * | 1/1997 | Rabjohns | 101/483 |
| 6,137,591 | A * | 10/2000 | Kikinis | 358/1.6 |
| 6,484,475 | B1 * | 11/2002 | Neagle et al. | 53/167 |
| 6,854,242 | B2 * | 2/2005 | Stork et al. | 209/203 |
| 2004/0179879 | A1 * | 9/2004 | Foley et al. | 400/61 |

* cited by examiner

*Primary Examiner*—Louis Huynh
(74) *Attorney, Agent, or Firm*—Nields & Lemack

(57) ABSTRACT

Apparatus for the automatic packaging of one or more articles. One or more modular infeed systems are provided, each adapted to feed product to a wrapping machine, and each preferably adapted to communicate with a wrapping machine to identify its configuration to the wrapping machine. In a preferred embodiment, each modular infeed includes a film roll unwind assembly, an integrated film folding head, a product conveyance mechanism and a closed-loop communications network.

8 Claims, 6 Drawing Sheets

Omni: Wrapper section only

Omni: Flighted modular infeed

Modular Dual-Belted Infeed

Modular Wide-Belt Infeed

MODULAR INFEEDS FOR AUTOMATIC FORMS/FILL/SEAL EQUIPMENT

FIELD OF THE INVENTION

The present invention relates to automatic package wrapping apparatus for wrapping packages with film, preferably heat sealable film. In particular, the present invention relates to a modular design including one or more modular infeed units that can be readily attached and detached from a form/fill/seal machine.

BACKGROUND OF THE INVENTION

Automatic wrapping or packaging machines are designed to wrap products in flexible sheets of plastic film, typically heat sealable thermoplastic shrink film, fully automatically at speeds that can approach 200 linear feet per minute, depending upon the package and the application. Briefly, products to be packaged are continuously fed into a form/fill/seal machine using an infeed such as a conveyor. A single sheet of flat or folded film is delivered to a forming plow from an overhead powered film unwind or an inverting head from a film unwind. The size and shape of the forming plow or the inverting head depends upon the size and profile of the product to be packaged. As the film is drawn over the forming plow or the inverting head, it is inverted and forms a tube of film inside the forming plow or the inverting head into which the product is conveyed. The product enters this tube of web material and the product itself serves to maintain the shape of the tube as the product and film then continues through the machine in unison. The two edges of the single web of film are overlapped on the bottom, side, or top of the product and are sealed together, such as with a static sealing system or a thermal sealing system. The product passes through end seal jaws that seal in between the packages and concurrently sever individual packages from the tube of film. The wrapped package then typically proceeds to a shrink tunnel located at the discharge end of the wrapping machine, which shrinks the thermal film tightly around the product. Occasionally, the wrappers are used to perform containment bagging functions only without the use of a shrink tunnel. Wrapping or packaging machines that utilize two webs of material, one fed from above the product and one fed from below, that automatically wrap around the product and are sealed also are known.

As the speeds of form/fill/seal machines increase, the mechanism that feeds the products into the wrapping machine becomes an increasingly important component of a successful packaging line. Conventional machines are designed with the product infeeds as an integrated component of the overall form/fill/seal machine. These machines do not facilitate a rapid changeover from one style infeed to another.

It would therefore be desirable to provide modular product infeeds that readily can be attached and detached from the wrapping section of a form/fill/seal machine in order to efficiently accommodate a wide variety of products to be packaged.

SUMMARY OF THE INVENTION

The problems of the prior art have been overcome by the present invention, which provides apparatus for the automatic packaging of one or more articles. More specifically, the present invention includes one or more modular infeed systems, each adapted to feed product to a wrapping machine, and each preferably adapted to communicate with a wrapping machine to identify its configuration to the wrapping machine. In a preferred embodiment of the present invention, each modular infeed includes a film roll unwind assembly, an integrated film inverting head, a product conveyance mechanism and a closed-loop communications network.

DETAILED DESCRIPTION OF THE INVENTION

Figure 1:
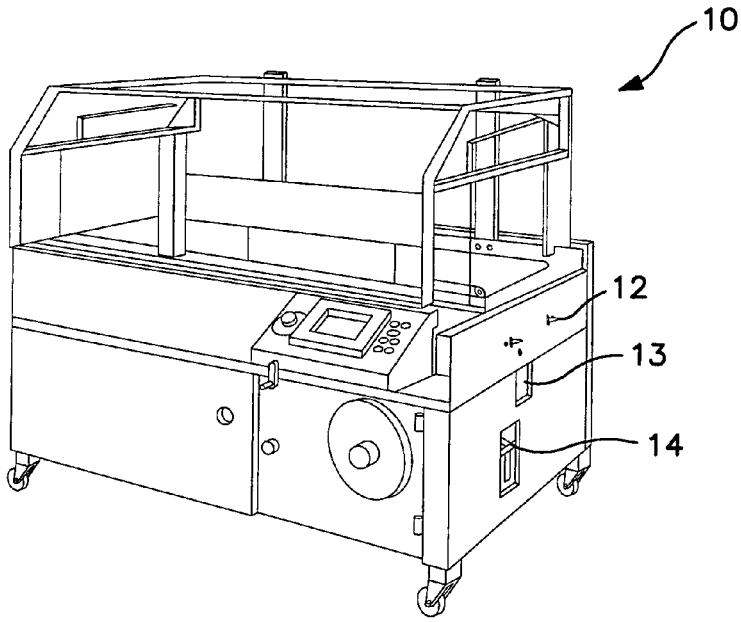
FIG. 1 is a perspective view of the wrapping section of a suitable packaging machine.

Turning now to FIG. 1, there is shown generally at 10 a wrapping section of a packaging machine. The wrapping equipment is generally conventional, except that it preferably does not include film unwind assembly or a film inverting head, as these components are now preferably included on the modular infeed assembly as discussed in greater detail below. Furthermore, the wrapping section 10 also differs from conventional designs in that it includes suitable connecting points and alignment members for readily attaching and detaching a modular infeed. Thus, one or more locating/aligning members 12 (two shown) are provided on the product-input end of the machine to assist in properly aligning the modular infeed with the wrapper. Similarly, a toggle connection 13 or the like is located at the product-input end to lock the modular infeed to the wrapper, as is an interconnection port 14 described in greater detail below.

Figure 2:
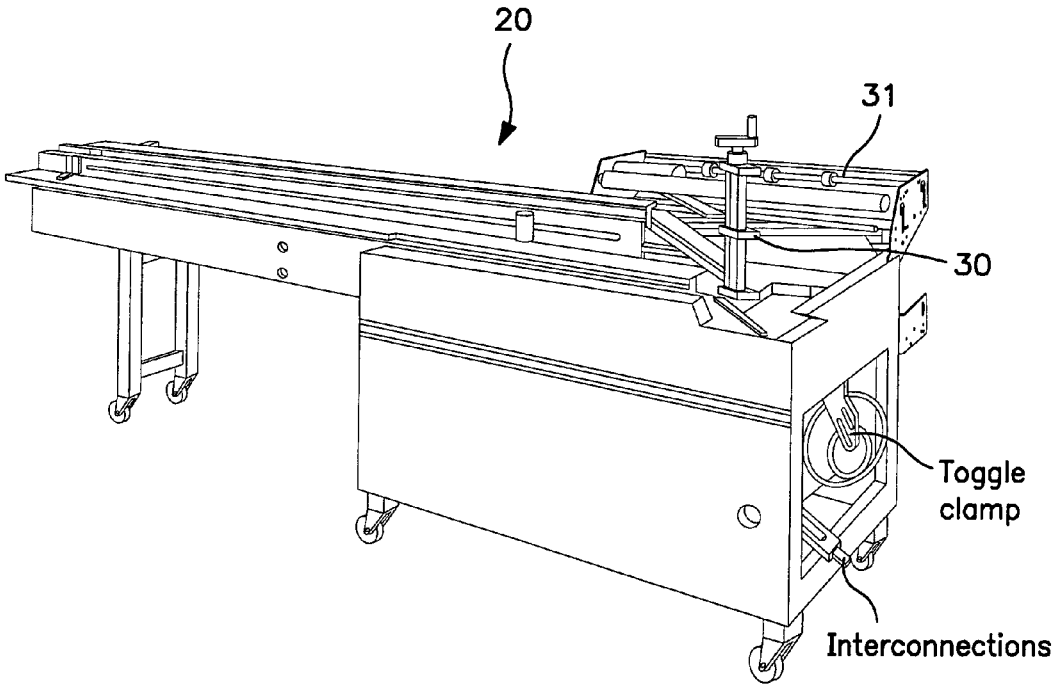
FIG. 2 is a perspective view of a modular infeed that can be attached to the wrapping section of FIG. 1.
Figure 4B:
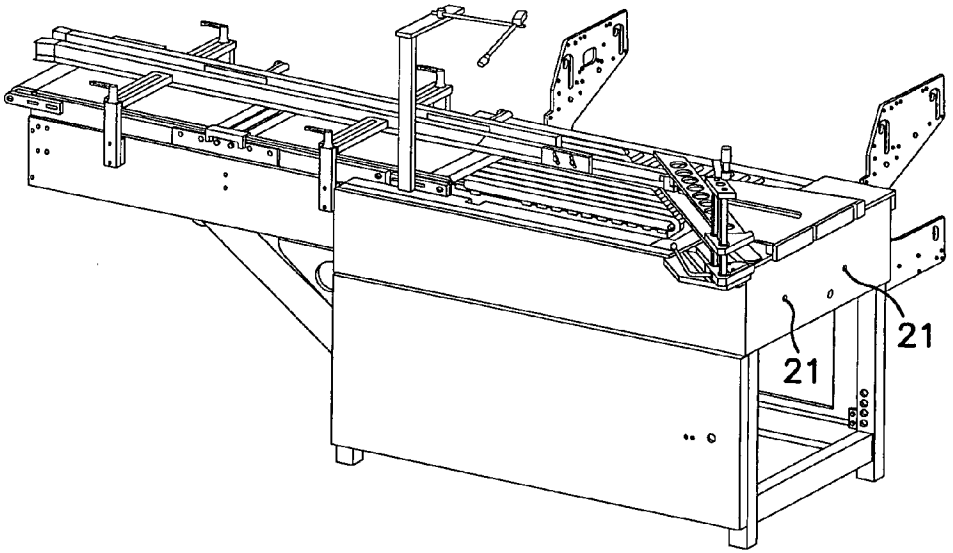
FIGS. 4A and 4B are perspective views of alternative embodiments of modular infeed assemblies.
Figure 4A:
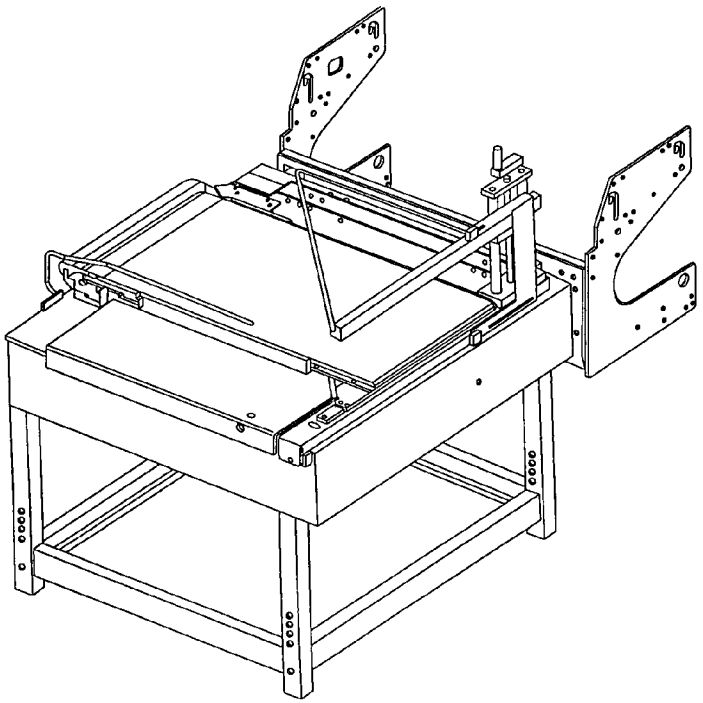

FIGS. 2, 4A and 4B illustrate examples of modular infeed units suitable for use in accordance with the present invention. In the embodiment shown, the infeed unit 20 is a flighted modular infeed. Those skilled in the art will appreciate that other types of infeed units are also suitable, such as a lugged infeed, multipackaging infeeds, the modular wide-belt infeed shown in FIG. 4A and the modular dual-belted in feed shown in FIG. 4B. The infeed unit 20 includes a flighted conveyor and can have a sophisticated control system that senses the location of the infeeding product and adjusts it automatically so that the product will be deposited between the flights of the wrapping machine's infeed conveyor.

Figure 5A:
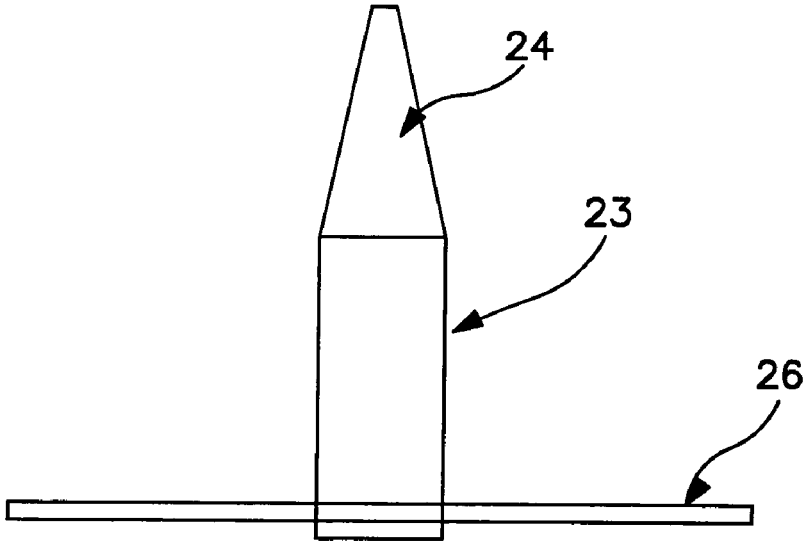
FIG. 5A is a cross-sectional view of an aligning pin for aligning a modular infeed with a wrapping section.
Figure 5B:
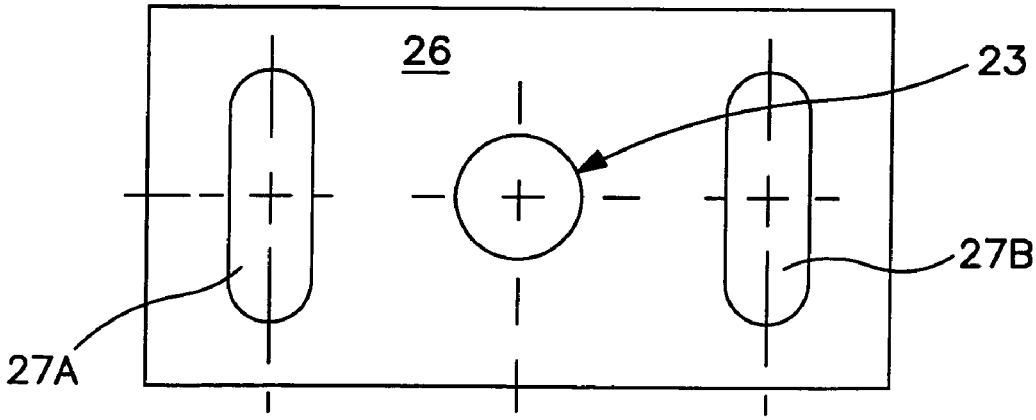
FIG. 5B is a front view of the pin of FIG. 5.

The end of modular infeed 20 that mates with the wrapping machine 10 input end preferably includes one or more alignment apertures 21 (best seen in FIG. 4B) that align with locating/aligning members 12 on the wrapping machine. Suitable aligning members 12 include pins shown in FIGS. 5A and 5B, preferably made of stainless steel. The pins have a cylindrical body 23 that terminates in a free tapered end 24.

Figure 3:
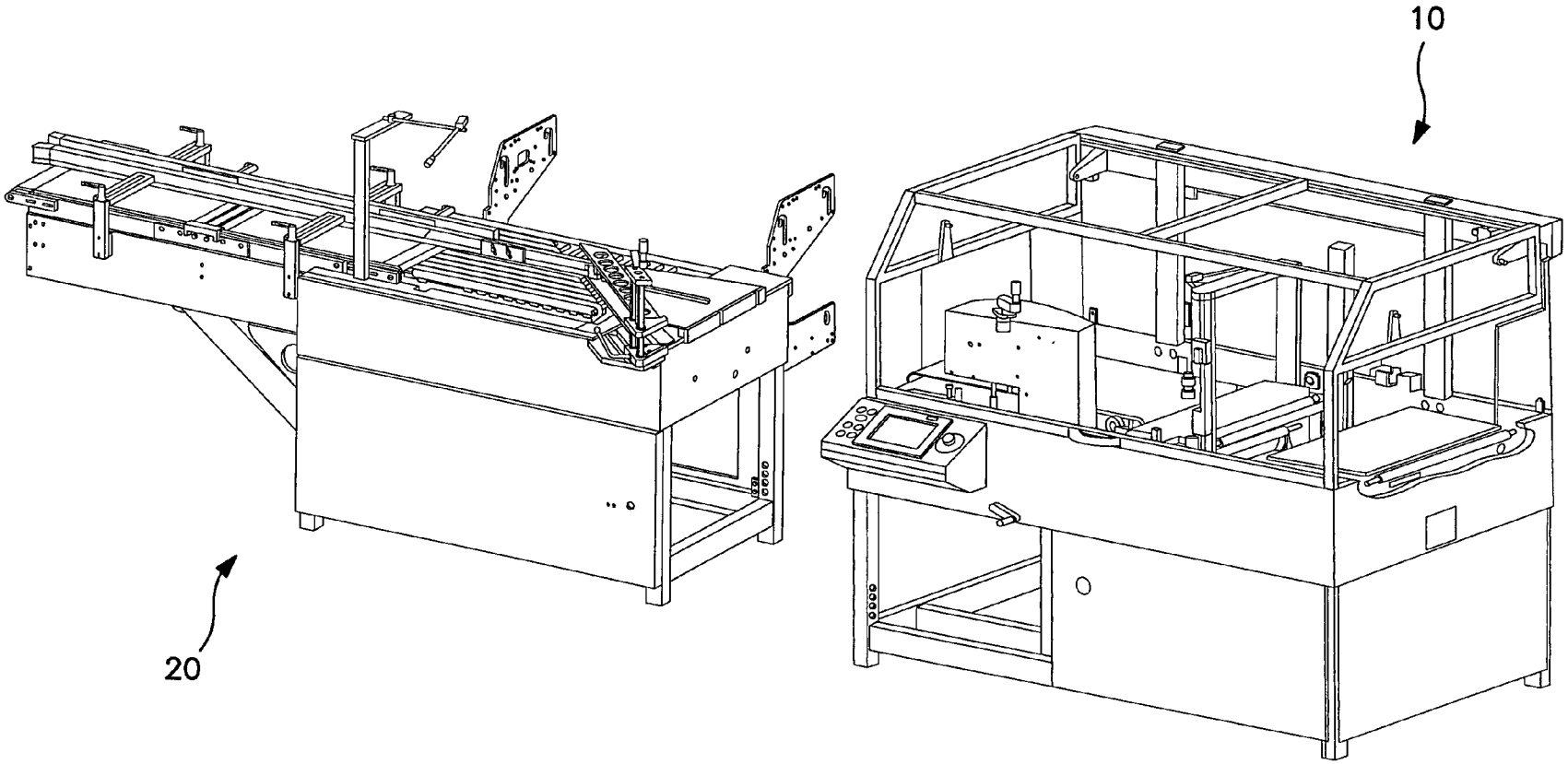
FIG. 3 is an exploded view of a wrapping section and a modular infeed assembly.

The tapered end helps facilitate locating and aligning the corresponding aperture 21 in the modular infeed unit. A mounting plate 26 can be coupled to the pin for mounting to the body of the wrapping machine, such as with suitable fastening members through holes 27A, 27B. Those skilled in the art will appreciate that although in the embodiment shown, the locating/aligning members 12 are located on the wrapping machine and the alignment apertures 21 are located on the modular infeed unit, these parts could be reversed. FIG. 3 illustrates a wrapping section 10 and modular infeed unit 20 positioned just prior to alignment and connection. Although in the embodiment shown, product flow is from left to right, the configuration can be reversed to accommodate right to left product flow.

The modular infeed unit 20 preferably includes an integrated film inverting head 30 conventionally present on the wrapping section. Similarly, the unit 20 preferably includes a film unwind assembly 31 also conventionally present on the wrapping section. By integrating these components on the modular infeed unit, proper alignment between the product conveying surface and the film is ensured. This greatly reduces infeed unit change-over time, since previously changing infeed units required difficult and time-consuming film alignment. The products to be packaged are thus inputted to the wrapping section by the modular infeed conveyor in a linear, horizontal path in between the two webs of film being unwound from the film unwind assembly 31. The conveyor preferably has an integrated drive system, and thus the unit 20 is self-contained and does not require drive transmission from the wrapping section 10.

Figure 6:
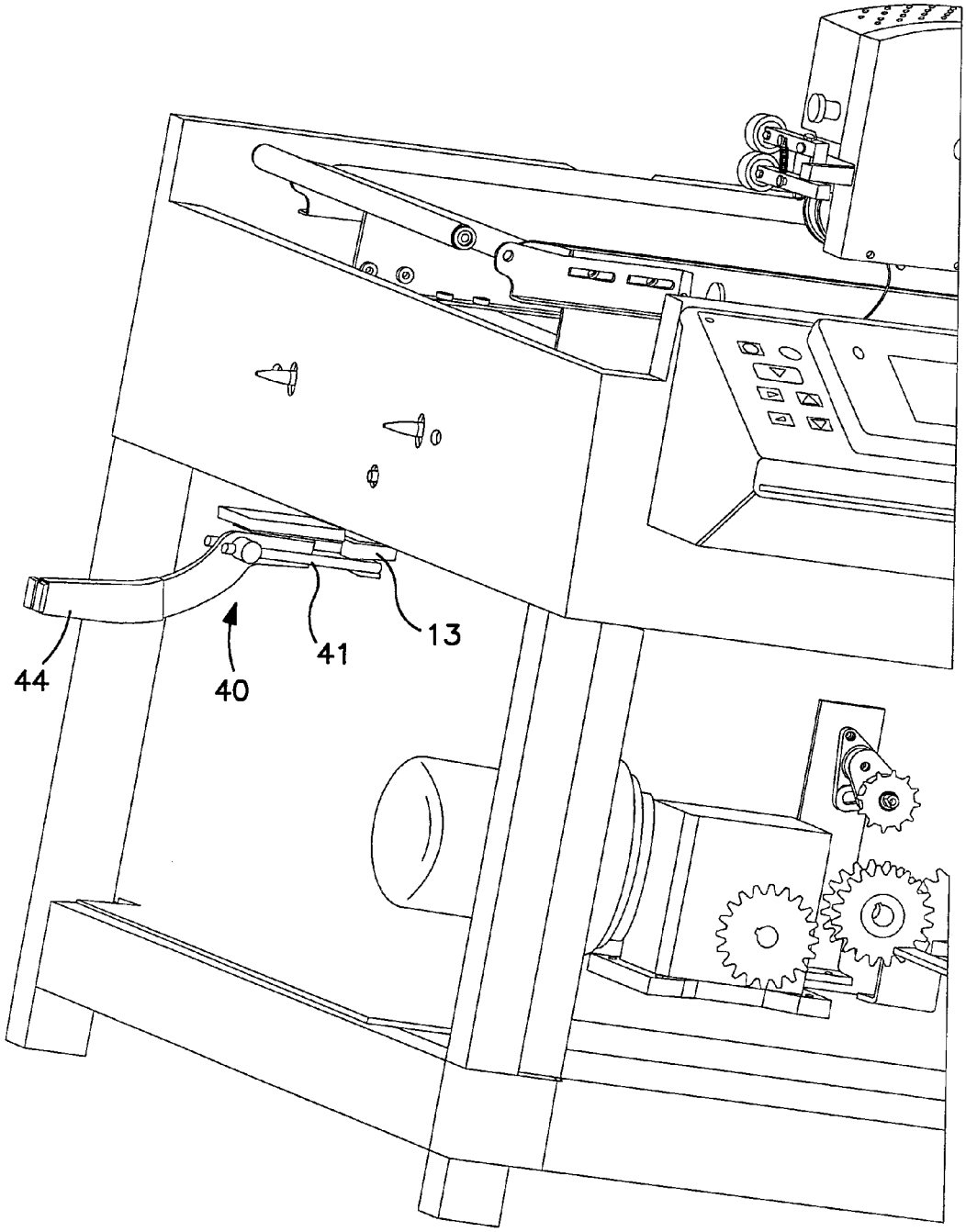
FIG. 6 is a partial perspective view of a wrapping machine showing the clamp for connecting the wrapping machine to a modular infeed.
Figure 7:
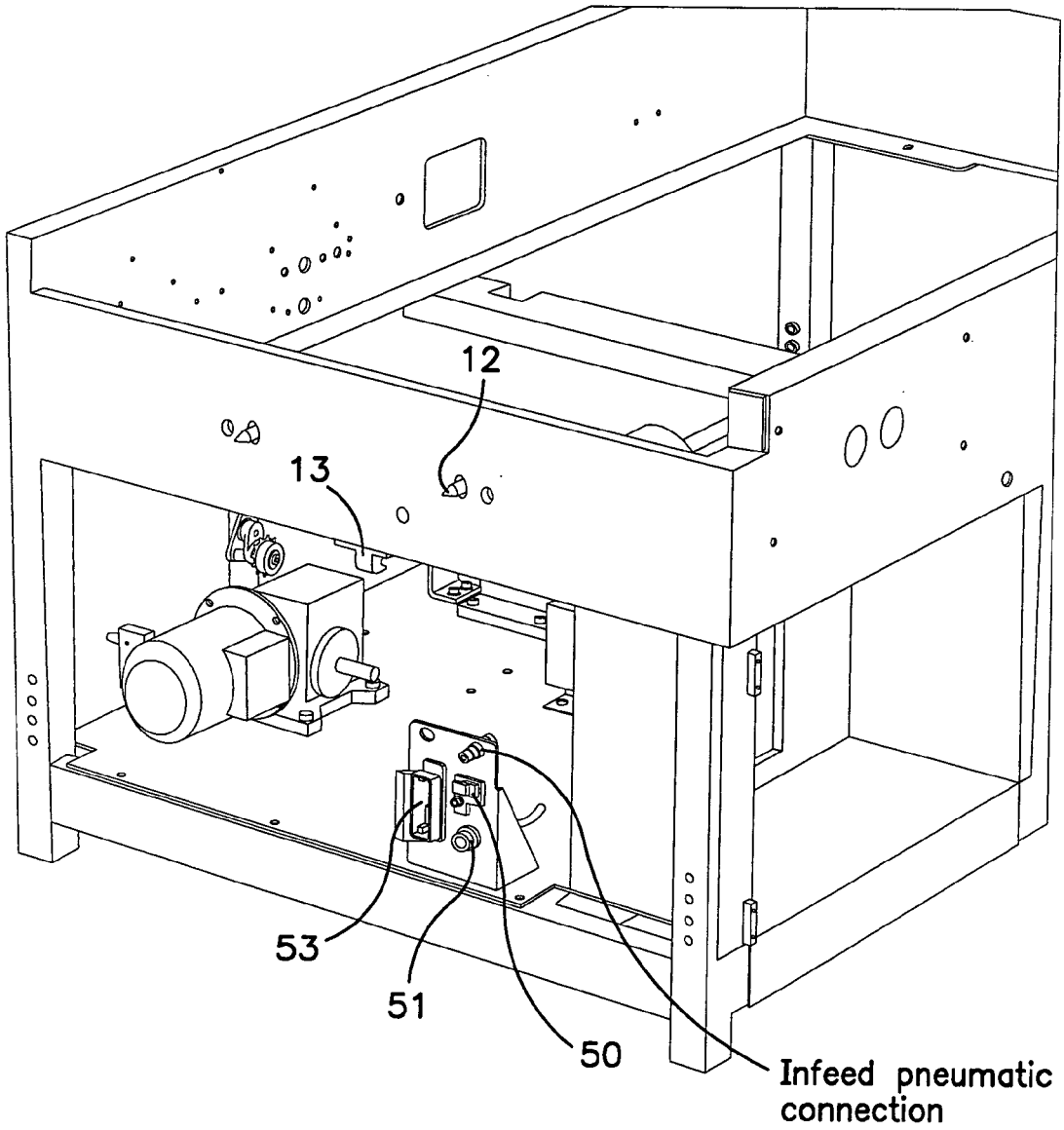
FIG. 7 is a partial perspective view of the input end of a wrapping machine in accordance with the present invention.

The wrapping section 10 and modular infeed unit 20, once aligned, can be locked together by any suitable locking mechanism. For example, a toggle clamp 40 (FIG. 6) can be used, which includes a loop 41 that secures to a latch 13 (FIG. 7). In the embodiment shown, the toggle clamp 40 is affixed to the modular infeed unit 20 and includes a handle 44. Appropriate actuation of the handle 44 moves that loop 41 into and out of locking engagement with the latch 13 located on the wrapping machine input end. When the loop 41 engages the latch and the handle 44 is further actuated to a locking position, the wrapping section and modular infeed unit are pulled together in locking relationship. Those skilled in the art will appreciate that the latch 13 could be located on the modular infeed unit, and the toggle clamp on the wrapping section, if desired.

Preferably the packaging machine assembly of the present invention also includes a communications system that allows the modular infeed unit to communicate with the wrapping section for identification purposes. For example, a closed-loop communications network established through coded inputs allows the modular infeed to identify the type of infeed it is (e.g., lugged infeed, dual belt infeed, etc.), including all integrated optional features. This will enable the wrapper section to respond accordingly. The communications network preferably also includes inputs available for current infeed options and has the capability to be expanded to accept future infeed options.

In the preferred embodiment, the wrapping unit has a connector, which is adapted to interface to a corresponding connector on the infeed machine. Preferably, the machines communicate using the DeviceNet™ protocol. DeviceNet™ is an open standard, creating by the Open DeviceNet™ Vendor Association (ODVA). The specification for DeviceNet™ can be found at www.odva.org, and is hereby incorporated by reference.

The wrapping machine contains a DeviceNet™-compatible controller, while the infeed machine contains a DeviceNet™-compatible chip, which receives the DeviceNet™ communications from the controller via the connector. The chip in the infeed machine also has sixteen general-purpose input/output pins, each of which can be connected to an input element, such as a switch or a sensor, or to an output element, such as a brake or clutch. When a pin is designated as an input, any attempts to write to it will be ignored. However, any pin designated as an output can be changed by writing a new value to that pin.

When the controller in the wrapping unit issues a read command, the chip in the infeed unit returns the state of each of its 16 general purpose input/output pins. Thus, the wrapping unit is able to obtain the current state of all input elements, such as sensors. Similarly, when the controller in the wrapping unit issues a write command, the device in the infeed unit overwrites the values of its output ports with those supplied by the controller during the write command. Values written to pins designated as input ports are not meaningful. Thus, through a write command, the wrapping unit is able to control the state of all output elements, such as brakes and clutches.

In the preferred embodiment, three pins are designated as inputs and are reserved for use as machine identifiers. Each of these inputs is permanently held in either an asserted state or a de-asserted state. The values of these three input pins allow the wrapping unit to identify the type of infeed unit to which it is attached. For example, if the first input pin is asserted, the infeed machine is a lugged infeed. If the second input pin is asserted, the infeed machine is a dual belt infeed. Finally, if the third input pin is asserted, then the infeed machine is a wide belt infeed.

While this embodiment utilizes three input pins to denote three different types of infeed machines, other encoding schemes are within the scope of the invention. For example, the values of the three pins could be combined to form a three bit binary value, thereby allowing eight possible machines to be identified. Alternatively, the machine identifiers can be used to denote specific features or functions available within the infeed machine.

While the preferred embodiment utilizes DeviceNet™ to communicate the infeed machine identifier to the wrapping unit, other protocols are possible and within the scope of the present invention. For example, protocols such as PROFIBUS, USB, Firewire, Ethernet, or other serial protocols can be utilized. Similarly, a parallel bus approach can be employed. Finally, wireless protocols such as Bluetooth™, WI-FI®, or 802.11a can be employed.

Additionally, other mechanisms for storing and communicating the machine identifier are also envisioned. For example, a serial EEPROM or ROM can be used to store and transmit the required identifier information. Similarly, dedicated pins on a connector can also be used to denote a specific infeed machine or feature.

FIG. 7 illustrates a preferred embodiment of the interconnections used to implement these features. Thus, a communications interconnect 50 is shown, which can be a five pin connector where two pins used for communication and node power, two are used for network communications, and one for ground. An infeed drive motor interconnect 51 can be a multi-in connector where three pins are used for an infeed three-phase drive motor and one or more pins are provided as spares. A safeties and power interconnect 52 also can be used, which can be a multiple pin connector with seven pins used for 120 VAC power, 24 VDC power, and hardwired wrapper safeties such as emergency stops, infeed access panel interlock switches, etc. Additional pins can be provided as spares, for future alternate platform models.

Preferably a controller is associated with the wrapping section 10 that will generate an error code and not allow the wrapper to run if there is no infeed connected, or if there is conflicting infeed identification (such as multiple infeeds identified through the communications network). Once the error is resolved, the running of the wrapper will again be enabled.

The modular infeed units of the present invention enhance the versatility of wrappers. End users can address changes in their products and/or processes by simply interchanging stand alone infeed units without having to purchase and stock multiple separate wrappers.

What is claimed is:

1. A modular infeed unit adapted to be attached and detached from a wrapping section of a form/fill/seal automatic film wrapping machine for wrapping a product traveling through said machine, said infeed unit comprising:

a product conveyor having a conveying surface;

a film unwind assembly;

a film folding head configured for inverting and folding film into a tube shape;

an electronic machine identifier; and a connector for providing communication between said infeed unit and said wrapping section to transmit said machine identifier to said wrapping section.

2. The modular infeed unit of claim 1, wherein said conveyor of said infeed unit is selected from the group consisting of f lighted infeed, lugged infeed, dual belt infeed and wide belt infeed conveyors.

3. The modular infeed unit of claim 1, further comprising an interlocking mechanism for attaching and detaching said unit to said wrapping section.

4. The modular infeed unit of claim 1, wherein said communication between said infeed unit and said wrapping machine is via a closed-loop communications network.

5. The modular infeed unit of claim 4, wherein said communications network is established through coded inputs.

6. A form/fill/seal automatic wrapping assembly comprising a wrapping section having means to receive an electronic machine identifier from one of a plurality of modular infeed units, and a modular infeed unit, selected from a plurality of modular infeed units, each of said modular infeed units adapted to be mounted and demounted from said wrapping section and comprising a product conveyor having a conveyor surface, a film unwind assembly, a film folding head configured for inverting and folding film into a tube shape, said electronic machine identifier, and a connector for providing communication between said infeed unit and said wrapping section to transmit said machine identifier to said wrapping section.

7. The form/fill/seal automatic wrapping assembly of claim 6, wherein said conveyor of each of said plurality of modular infeed units is selected from the group consisting of flighted infeed, lugged infeed, dual belt infeed and wide belt infeed conveyors.

8. The form/fill/seal automatic wrapping assembly of claim 6, wherein said communication between said infeed units and said wrapping machine is via a closed-loop communications network.

* * * * *